United States Patent [19]

Duff et al.

[11] Patent Number: 4,762,734

[45] Date of Patent: Aug. 9, 1988

[54] PROCESSES FOR THERMAL TRANSFER INK DONOR FILMS

[75] Inventors: James M. Duff, Mississauga; Randolph E. Branston, Sarnia, both of Canada

[73] Assignee: Xerox Corporation, Stamford, Conn.

[21] Appl. No.: 934,362

[22] Filed: Nov. 24, 1986

[51] Int. Cl.[4] ..... B41M 3/12

[52] U.S. Cl. ..... 427/146; 106/31; 106/32; 427/130; 427/384; 427/393.5; 427/395

[58] Field of Search ..... 427/153, 146, 384, 393.5, 427/395, 130; 106/31, 32

[56] References Cited

U.S. PATENT DOCUMENTS

| | | | |
|---|---|---|---|
| 2,499,004 | 2/1950 | Seil et al. | 260/33.6 |
| 3,336,150 | 8/1967 | Takahashi et al. | 117/36.1 |
| 3,404,021 | 10/1968 | Newman et al. | 427/153 |
| 3,549,209 | 7/1971 | Kosche et al. | 427/153 |
| 3,957,495 | 5/1976 | Teranishi et al. | 106/19 |
| 4,251,276 | 2/1981 | Ferree et al. | 106/27 |
| 4,407,886 | 10/1983 | Hoffman et al. | 428/320.8 |
| 4,454,194 | 6/1984 | Luebbe | 427/146 |
| 4,503,095 | 3/1985 | Seto et al. | 427/265 |

FOREIGN PATENT DOCUMENTS

| | | | |
|---|---|---|---|
| 1409672 | 10/1975 | United Kingdom | 427/153 |

OTHER PUBLICATIONS

IBM Technical Disclosure Bulletin, vol. 27, No. 3, Aug. 1984, pp. 1806 and 1807.

*Primary Examiner*—Janyce A. Bell
*Attorney, Agent, or Firm*—E. O. Palazzo

[57] ABSTRACT

An emulsion process for the preparation of thermal ink donor films which comprises (1) the addition of wax or soluble polymer components to a warm hydrocarbon solution; (2) adding thereto first additives that are soluble in the solution; (3) forming an emulsion thereof by adding the formed solution to an alcohol or a polar solvent, which may also contain dissolved second additives, grinding the resulting emulsion with a suitable pigment; (4) coating the product obtained on a supporting substrate; and (5) thereafter heating to enable evaporation of the hydrocarbon.

17 Claims, No Drawings

PROCESSES FOR THERMAL TRANSFER INK DONOR FILMS

BACKGROUND OF THE INVENTION

The present invention is generally directed to processes for obtaining ink donor films; and more specifically the present invention is directed to an emulsion coating method for generating thermal transfer ink donor sheets. Therefore, in one embodiment of the present invention there is provided a process for thermal ink donor films by causing the grinding of a formed emulsion containing the appropriate components, and thereafter heating to remove the solvents present enabling the effective dispersion of pigment particles in a polymer or wax composition. The sheets obtained in accordance with the process of the present invention are useful in known thermal transfer printing methods, such as those described in *Thermal Transfer Printing: Technology, Products, Prospects,* Published by Datek Information Services, P.O. Box 68, Newtonville, Mass.; or in the *IBM Journal of Research & Development,* Vol. 29, No. 5, 1985, the disclosures of which are totally incorporated herein by reference.

Thermal printing is a nonimpact process that permits the formation of images of excellent resolution; and further these processes are simple in design, offer low undesirable noise levels, and are very reliable over extended usages. Two classifications of the aforementioned thermal printing processes are direct thermal printing, and thermal transfer printing. In the direct method there are selected special papers coated with heat sensitive dyes, while in the transfer method an intermediate sheet is initially coated with a pigmented layer from which certain areas thereof are transferred to a receiving substrate to provide a final printed image. Direct thermal printing is not preferred in that, for example, the prints resulting are subject to fading, and thus have poor archival characteristics. Also, it is known that the direct thermal transfer papers are of an aesthetically objectionable appearance. In contrast, with thermal transfer printing methods there are used uncoated plain papers enabling prints with acceptable appearance, and excellent archival properties. Another advantage of the thermal transfer printing method resides in its applicability to color printing wherein there can be selected multicolored ink donor films.

In the aforementioned thermal transfer printing processes there is selected a thermal print head, an ink donor film comprised of thin paper, or a plastic film coated with a solid heat fusable ink, and a plain paper receiver sheet. To obtain final prints there is placed in contact with the receiver sheet the ink side of the donor film, followed by the application of heat originating from the print head to the film. Heat conducted through the donor film increases the temperature of the ink to above melting permitting the ink to wet the receiver sheet, and finally resolidify thereon. Since the receiver sheet is wet by the molten ink, and is rougher in texture than the smooth donor film base, the resolidified ink preferentially adheres to the receiver. Subsequent to separation of the receiver sheet from the ink donor film, there results transferred ink on the imaged areas of the receiver. Alternatively, as described in the aforementioned IBM Journal disclosure, the heating may be generated by passage of an electric current through a resistive layer which is an integral part of the film.

More specifically, the ink donor films selected in the prior art are generally comprised of a thin base film, such as glassine, condenser paper, or polyester substances with a coating thereover of pigmented wax or polymer. The supporting substrate, or smooth base film is from about 5 to about 20 microns in thickness, and is of sufficient strength to permit use thereof without tearing. Since the primary function of the substrate is to transport heat from the printhead to the ink layer, its properties should be designed to the extent that it has high intrinsic thermal conductivity. Further, the sheet selected should be thin, that is for example about 20 microns or less, and smooth to allow for the more effective transfer of heat. Additionally, the substrate sheet is formulated in a manner to withstand the high printhead temperatures, about 300 degrees Centigrade, for several milliseconds without melting or charring.

Donor ink compositions presently utilized are comprised of pigmented waxes or low molecular weight polymers, which are generally blended to permit the formation of a film. Blending is affected to generate a reasonably hard film with a low melt viscosity when subjected to heat of a temperature of from 60 to 80 degrees Centigrade originating from the printhead. Thus, normally the film is formulated from the blending of hard paraffin waxes with softer ester waxes. Also, the wax with pigment therein is coated on the substrate by, for example, gravure or roll coating methods.

Other important characteristics associated with ink donor films, which characteristics are achievable with the process of the present invention, include substantial adherence of the final ink film to the donor film base. Moreover, the ink donor film should be of sufficient resiliency to enable reasonable deformation without flaking; and additionally, possess a temperature viscosity profile permitting a relatively sharp decrease in the viscosity of the ink donor film at its melting point. Additionally, the coating selected for the aforementioned ink donor films should be substantially abrasion resistant to prevent transfer of the coating to the contact receiving sheet. Furthermore, there is desired ink donor films that permit smear resistant images subsequent to transfer to other substrates. Also of importance is that the ink layer selected should have a low degree of surface tackiness to prevent adherence to itself at normal operating temperatures when subjected to light rolling, an object achievable with the invention of the present application.

Many of the aforementioned desirable characteristics require the use of a variety of additives to the ink layers including, for example, oils and plasticizers. These additives, which are selected to modify the mechanical properties of the film, for example, include specifically high molecular weight polymers such as cellulosic derivatives for controlling melt viscosity and tensile strength, and commercially available ethylene-vinyl acetate copolymers which are used to modify adhesion properties and surface tackiness. Further, pigment dispersants known in the art can be incorporated into the ink donor films to increase the optical density thereof.

Presently, most ink donor films are prepared by melt blending pigments, and optional additives dispersed in a wax, followed by the hot melt coating of the resulting ink on a suitable substrate, such as Mylar or condenser paper. Solution coating is not feasible for obtaining the donor sheets in view of the solubility characteristics of the ink components, that is for example the waxes are insoluble in common commercially available solvents at normal temperatures. Further, while hot melt blending and coating processes are satisfactory for generating ink donor sheets of reasonably uniform properties, minimum dispersion of the pigments occur because of the poor wetting characteristics of the wax. Also, the high solids content, essentially 100 percent, of the melt creates substantial difficulties in controlling the coating parameters, such as viscosity and leveling. The use of the commercially available additives indicated hereinbefore to control properties such as pigment dispersion, surface tension, tensile strength, melt viscosity, leveling, and smear and abrasion resistance is restricted to materials that are soluble or readily dispersible in the wax melt, and which do not otherwise adversely effect the hot melt coating properties.

Thermally activated inks and transfer ribbons are illustrated in U.S. Pat. No. 4,503,095, the disclosure of which is totally incorporated herein by reference. Specifically, there is described in this patent, a thermally activated medium which can be used for color printing, which contains a multiplicity of inks such as cyan, magenta and yellow ink compositions applied side by side on a substrate. The ink selected comprises a wax blend, softening agent, pigment, extender pigment and heat-conductive powder which is applied to the substrate as a hot melt. Other prior art includes U.S. Pat. No. 3,970,002 directed to inks comprising dye-wax-oil compositions which are also coated by hot-melt methods. Further, U.S. Pat. No. 4,308,318 discloses the preparation of thermally activated transfer ribbons for nonimpact printers in which the thermal ink layer is prepared by organic solvent-based coating and comprises a polyamide, and pigment and dye dispersed in propyl alcohol. In addition, there is disclosed in U.S. Pat. No. 4,251,276 similar formulations using a mixed solvent system as the coating vehicle. Moreover, in U.S. Pat. No. 3,336,150 there is disclosed an impact copying sheet and wherein, for example, there is described a process for suspending or dispersing colorants in a liquid vehicle, dissolving a carrier resin or wax in a solvent, and thereafter combining the aforementioned materials by ball milling, followed by solvent evaporation. However, there is no disclosure in the prior art relating to the preparation of ink donor films by dissolving the carrier wax or polymer in a liquid vehicle, dispersing the colorant and optional additives in a different liquid, and combining the two immiscible materials by ball milling, followed by coating onto a substrate as achieved with the process of the present invention. Additionally, references of background interest include U.S. Pat. No. 2,499,004; 3,957,495; and 4,407,886; European Patent Applications 63,000 and 82,270; Japanese Patent Publication 33174 (284); and IBM Disclosure, Volume 27, Number 3, pages 1806 to 1807.

Although the above hot melt blending and homogeneous solution processes for generating donor film compositions are suitable for their intended purposes, there continues to be a need for new processes. Additionally, there continues to be a need for formulation methods that will enable ink donor films with uniform characteristics, and wherein the pigments are more completely dispersed in the waxes or polymers selected. Further, there is a need for donor film processes wherein melting the wax component to permit coating is eliminated. Also, there is a need for ink donor film formulation methods that will provide ink composition coatings of a substantially uniform thickness thereby enabling the generation of uniform color prints. Moreover, there is a need for processes for donor films that are relatively simple, and wherein the solvents used are recoverable, and can be recycled for repeated usage. In addition, with the process of the present invention dispersing agents can be avoided; and also the use of a polar dispersing media permits the incorporation of optional wax incompatible additives, such as alcohol soluble dyes, and surface active or viscosity controlling polymers, including cellulosic derivatives. Additionally, with the process of the present invention, the use of other known additives for the purpose of controlling properties such as surface tackiness, tensile strength, adhesion characteristics, and abrasion resistance is simplified compared to prior art processes. Furthermore, the emulsion dispersions formulated in accordance with the process of the present invention are somewhat thixotropic allowing stability during storage. Moreover, the process of the present invention permits the coating of the ink composition to be accomplished at room temperature.

SUMMARY OF THE INVENTION

It is an object of the present invention to provide processes for ink donor films which overcome many of the above-noted disadvantages.

In another object of the present invention, there are provided emulsion processes for obtaining ink donor films.

In still another object of the present invention, there are provided ink donor film processes wherein the solvents used are recoverable.

A further object of the present invention resides in the provision of emulsion processes wherein there is permitted the selection of a variety of different waxes, polymers, pigments, dyes, and additives.

Also, in a further object of the present invention there are provided ink donor film processes which are economical, and enable films of uniform, consistent characteristics.

Another important object of the present invention is the provision of emulsion processes for ink donor films wherein wax incompatible additives, such as alcohol soluble dyes, and surface active polymers like cellulose derivatives can be used.

In another object of the present invention, there are provided emulsion processes for obtaining ink donor films at ambient temperatures, as contrasted to higher temperatures for the known hot melt processes.

These and other objects of the present invention are accomplished by the provision of processes for ink donor films. More specifically, in one embodiment, the present invention is directed to processes for ink donor films comprising the addition of polymer and/or other components to a warm, from about 50 degrees Centigrade to about 100 degrees Centigrade, hydrocarbon solvent solution (nonpolar solution); adding thereto additive components that are soluble in the hydrocarbon solvent; forming an emulsion thereof by adding the aforementioned solution to an excess amount of a polar liquid such as an aliphatic alcohol at room temperature; grinding the resultant emulsion; coating the product obtained on condenser paper; and thereafter heating to enable evaporation of the solvent.

Additionally, in another embodiment of the present invention there is provided a process for the preparation of thermal ink donor films which comprises (1) the addition of wax and/or polymer components to a warm hydrocarbon solution; (2) adding thereto additives that are soluble in the aforementioned solution; (3) subsequently forming an emulsion thereof by adding the resulting formed solution to an excess amount of polar liquid which contains pigment and optional additives; (4) grinding the resulting emulsion; (4) coating the product obtained on a supporting substrate; and (5) thereafter heating to enable evaporation of the hydrocarbon selected.

Therefore, a specific ink donor film of the present invention can be prepared by adding a component of a solution of a wax inclusive of known paraffin waxes, and/or a solution of a polymer, such as polyethylene having a molecular weight of about 7,000, which component is present in an amount of from about 5 percent by weight to about 50 percent by weight dissolved in an aliphatic or aromatic hydrocarbon solvent such as heptane, toluene or mineral spirits at a temperature of from about 60 to about 150 degrees Centigrade, which temperature depends on the melting and solubility characteristics of the wax or polymer component to a polar liquid in which the hydrocarbon solvent is immiscible such as methanol, ethanol, propanol, isopropanol, and the like, wherein, for example, from 100 parts of polar liquid to from about 10 parts to about 100 parts of wax or polymer solution are present; subsequently adding thereto in an amount of from about 1 to about 30 parts of carbon black or other pigments which would permit products with, for example, cyan, magenta or yellow primary colors or highlight colors such as red, blue, green or brown, reference U.S. Serial No. 846,668, relating to processes for colored toners; and Gruber et al. U.S. Pat. No. 4,604,338, the disclosures of each of the aforementioned documents being totally incorporated herein by reference; and known additives soluble in the alcohol inclusive of, for example, hydroxypropyl cellulose which additives provide for controlling the ink melting viscosity. Thereafter, the resulting mixture is subsequently subjected to a grinding operation by known techniques including sand milling, ball milling or attrition for a period of from about 1 to about 72 hours for the primary purpose of reducing the particle size of the dispersion to about less than 1 micron, followed by coating the product resulting on a thin substrate inclusive of Mylar or condenser paper to a wet thickness of from about 20 to about 200 microns. There results a dry film after evaporation of the hydrocarbon solvent preferably at room temperature, however, temperatures of up to 150 degrees Centigrade may be useful depending, for example, on the components selected, an ink donor film of a thickness of from about 2 to about 20 microns comprised of a matrix of the wax or polymer component with the pigment and other additives such as the oils, dyes and polymers described herein either dissolved or uniformly dispersed therein.

Another process feature of the present invention resides in the possibility of being able to select either an alcohol- or hydrocarbon-soluble dye as the coloring agent rather than a pigment, and in this situation only a short grinding operation (or possibly high shear mixing alone) would be needed to obtain a regularly coated emulsion. The selection of dyes in place of pigments usually enables a more economical process, and permits the formulation of many different colored ink compositions.

Examples of hydrocarbon or non-polar solvents selected for preparing the wax or polymer solution include aliphatic components, especially isomeric hexanes, heptanes, octanes, nonanes, or other similar saturated or unsaturated aliphatic solvents with from about 5 to about 15 carbon atoms; aromatic solvents such as benzene, toluene, xylene, ethylbenzene, and the like, with a boiling point between about 80 and 200 degrees Centigrade; and other commercially available aliphatic, aromatic or mixed mineral spirits available as Solvesso (EXXON), Isopar (Shell) or Magiesol (Magie Brothers). Preferred non-polar solvents are mineral spirits such as Isopar G available from Shell, since these are non-toxic, odorless and have a moderately high, greater than 100° F. flash point.

Any of the four major classes of waxes in an amount of from 1 to about 50 percent by weight of the hydrocarbon solution inclusive of natural (beeswax, carnuba), mineral (montan, ester wax), synthetic (low molecular weight, weight average of from about 7,000 or less) polyethylenes; poly(vinyl ethers), petroleum (paraffin wax), and/or other resins and polymers, which are soluble in the hot hydrocarbon component, can be selected as the component in the coating. Examples of polymers are Piccotex 75, Piccotex 100, Polypale Ester 10 (all available from Hercules), terpene resins such as Nirez 1085 (available from Reichold) or Zonarez type 7115 (available from Arizona Chemical Company), and a variety of different ethylene-vinyl acetate copolymers such as Elvax 420 available from E.I. DuPont, or EVA 1 available from BASF can be selected.

As first additive components there can be selected mineral, vegetable, or synthetic oils in an amount of from about 1 to about 50 percent by weight of the wax or polymer, which components are added to the hydrocarbon component to provide a plasticizing effect on the wax or polymer, and for the purpose of desirably controlling the ink's melt viscosity to a value of from about 10 to about 300 centipoise. Preferred additives are low viscosity mineral oils such as the Blandol series (available from Witco Inc.), refined bleached rapeseed oil (available from L.V. Lomas Inc.), and dibutyl or dioctyl phthalates (available from Eastman Kodak). A typical formulation might contain, for example, 2 parts of Blandol 80 and 8 parts of the wax component.

The polar liquid in which the hydrocarbon solvent component is dispersed includes liquids having a boiling point from about 50 to about 200 degrees Centigrade in which the solvent is immiscible. Examples of suitable liquids present in effective amounts as indicated herein are low molecular weight aliphatic alcohols such as methanol, ethanol and the isomeric propyl and butyl alcohols; and other polar liquids such as acetic acid, dimethyl sulfoxide, dimethyl formamide, ethylene and propylene glycols, and mixtures thereof. Water may also be added in combination with the above polar organic liquids in amounts of up to about 75 percent by weight of the total. Preferred polar liquids are ethanol, isopropyl alcohol and n-propyl alcohol.

Illustrative examples of pigments, or mixtures thereof in amounts of from about 5 to about 80 percent by weight of the final dry coated ink donor film that can be readily dispersed in the polar liquid, or the coating formulations of the present invention, include carbon blacks such as furnace blacks, lamp blacks, channel blacks and Paul Uhlich Co. Toner 8200 (a mixture of carbon black and blue dye precipitated as a lake); colored organic pigments such as triphenylmethanes, phthalocyanine blue, phthalocyanine green, Red Lake C, Monolite Fast Red, arylazonaphthol reds and magentas, benzidene yellow and red to blue shade perylenes; inorganic pigments such as ultramarine, chrome yellow, titanium dioxide and iron oxides, especially brown oxides, magnetites; and the like. Preferred pigments selected are high surface area carbon blacks such as Columbian Raven 3500 or 5750 and Cabot Black Pearls L, and organic pigments which provided films having high quality primary subtractive colors (cyan, magenta and yellow) and strong highlight colors (blue, green and red).

Additionally, specific examples of pigments which are incorporated in the emulsion formulation at levels corresponding to from 5 to 40 percent by weight of the final dry coating providing primary and highlight colors are Lithol Rubine 2739, Lithol Red 2319, Toludine Red and Diarylide Yellow AAMX (all available from Dominion Color and Chemical); Phthalo Blue G NCNF, Lumogen Yellow, Lithol Scarlet, Heliogen Green L8730 and Heliogen Blue L6900 (all available from BASF); Hudson Blue BL-3059, Violet Toner #VI-8015, Royal Brilliant Red RO-8192, Supergloss Green and Argyl Green (all available from Paul Uhlich Co.); and Cinquasia Green G, Cinquasia Magenta and Wachtung Red (from Dupont).

Optional second additive colorants particles that may be used either alone or in combination with the pigments illustrated herein, and which may be added to the polar media in amounts of from about 3 to about 30 percent by weight of final dry coating, include soluble dyes such as, but not limited to, crystal violet, methylene blue, sulfur black, Sudan Blue, direct fast yellow, and the Orasol series of colors available from Ciba Geigy. These dyes, when used alone as the colorant, will allow a much faster processing time of about 1 hour as compared to pigments which could require many hours or even several days to be fully dispersed.

A variety of soluble polymers in amounts of from about 1 to about 10 percent by weight of the final dry coated solid could also be added to the polar medium to control coating and print quality parameters such as leveling, dispersion, adhesion, ink melt viscosity and rub resistance. Preferred polymer additives were cellulosic polymers such as hydroxypropylor ethyl-cellulose. It is well known, for example, that these polymers at levels of a few percent can raise the viscosity of organic liquids by a factor of 10 or more. Other polymers such as poly(vinyl alcohol), polyethylene- and polypropylene-glycol can be added to improve the leveling and gloss of the dried films.

The following examples are being supplied to further define various species of the present invention, it being noted that these examples are intended to be illustrative only and are not intended to limit the scope of the present invention; parts and percentages are by weight unless otherwise indicated.

EXAMPLE I

Thermal ink donor films were prepared by accomplishing the following:

PART A:

Polar Component Containing Pigment and Optional Soluble Polymers

Eight samples of pigment dispersion were prepared by stirring 2 grams of the pigments listed in Table 1 in 70 milliliters of isopropyl alcohol in an 8 oz. polyethylene jar one-half filled with ¼ inch stainless steel balls. Alcohol soluble additives were also added to this jar as indicated in the Table.

PART B:

Hot Wax or Polymer Solution

Eight samples of solution were prepared by gently heating 8 grams of the wax and/or polymers described in Table 1 with 20 milliliters of Isopar G odorless mineral spirits. The wax and hydrocarbon soluble additives dissolved with gentle stirring at a temperature of about 100 degrees Centigrade.

Hot B at about 80 degrees Centigrade was added to cold A at about 20 degrees Centigrade with gentle stirring and the resultant suspension was processed on a ball mill, to enable grinding, for 21 hours. The suspensions were then coated on 0.5 mil Mylar film using a #28 wire wound rod (nominal wet film thickness 72 microns, dry thickness about 7 microns). The samples were air dried to yield a matte-finished coating which could be used as is in a thermal transfer printer. Areas of these coatings were heated using an infrared lamp, laboratory hot air blower, or oven until the wax coating melted; and a shiny coating more translucent than the unheated coating resulted. The dry thickness of the coatings ranged from about 5 to 7 microns as measured by a Dermitron Instrument. The transmission optical density of the heated, coated films are shown in the Table; all were over 2 optical density units indicating excellent dispersion of the pigments.

TABLE 1

| Example | PART A Component(s) Added to Alcohol-Weight (grams) | PART B Components Dissolved in Hot Isopar-Weight (grams) | Optical *Density of ink Donor Film |
|---|---|---|---|
| I | Uhlich Toner 8200(2) | Hoechst Wax E(8) | 2.4 |
| II | Uhlich Toner 8200(2) | Paraffin Wax(4)<br>Carnauba Wax(4) | NA |
| III | Uhlich Toner 8200(2) | Paraffin Wax(3)<br>Carnauba Wax(3)<br>Mineral Oil(2) | 3.0 |
| IV | Uhlich Toner 8200(2) | Paraffin Wax(3)<br>Carnauba Wax(3)<br>Elvax 420<br>Copolymer(2) | 2.5 |
| V | Hydroxypropyl Cellulose(1)<br>Uhlich Toner 8200(2) | Hoechst Wax E(3)<br>Polywax 1000(4) | 3.6 |
| VI | Uhlich Argyle Blue Pigment(2)<br>Hydroxypropyl Cellulose(1) | Hoechst Wax E(4)<br>Carnauba Wax(2)<br>Elvax 420(1) | 4.0 |
| VII | Uhlich Argyle Green Pigment(2)<br>Hydroxypropyl Cellulose(1) | Hoechst Wax E(4)<br>Carnauba Wax(2)<br>Elvax 420(1) | 2.0 |
| VIII | Dominion Color & Chemical Lithol Red Pigment(2)<br>Hydroxypropyl Cellulose(1) | Hoechst Wax E(4)<br>Carnauba Wax(2)<br>Elvax 420(1) | 2.0 |

*MacBeth TR927 Densitometer-Red light was used for the green and blue films 6 and 7; green light was used for the red film #8.

All films were very uniform in color indicating good coating and leveling properties of the emulsion, however, those films with no first additive components had the disadvantages as noted hereinafter.

The film of Example I adhered well to the substrate, but it proved to be somewhat brittle and flaked off when the coating was rolled around a one half inch diameter rod. In Example II, the coating was very brittle and showed relatively poor adhesion to the substrate in that it could easily be rubbed off with finger contact.

In contrast with Example III, there was provided a coating with excellent adhesion and good flexibility which stuck very well to the substrate even when the film was folded and creased firmly. This is attributed to the plasticizing effect of the oil additive on the paraffin-carnauba wax mixture. However, this coating proved to transfer from the film under light pressure, for example, by writing on the back of the film using a ball point pen, and behaved more like a carbon paper than a thermal donor film. Example IV in which the paraffin-carnauba wax mixture was modified with Elvax 420, a polyethylene-vinyl acetate copolymer available from DuPont, also proved to have excellent adhesion to the film. This film was much tougher than that of Example III and showed no "carbon paper effect" when a ball point pen was used on the back surface. This shows the effect of Elvax 420 at a level corresponding to 10 percent of the dry coating in improving adhesion, flexibility and the toughness of the film. Example V, prepared using a blend of Hoechst Wax E and Polywax 1000, a low molecular weight polyethylene (Bareco Division of Petrolite), was very similar in brittleness and adhesion properties to Example I in that flaking resulted when the coating was rolled around a one half inch diameter rod. Examples VI to VIII were brightly colored, red, blue, and green coatings which showed no tendency to flake whatsoever when the coating was firmly creased; and with these examples no "carbon paper affect" was observed.

Thereafter, all the thermal film samples, with the exception of Example II, were spliced into the donor film roll of a Diablo EPM-API thermal transfer printer, and a test pattern was printed on Xerox 4024 paper using these films. The resultant test patterns were used to compare the overall performance of the present IDF (ink donor film) formulations with that of the same test patterns printed using a commercial IDF available from Diablo Systems as product number 8R2287.

The transfer efficiency of the various coating was compared by examining the IDF after it had been used. Example V showed poor transfer efficiency in that only about 50 percent of the ink was transferred to the receiver sheet. The coating of Examples I, III, IV, VI, VII and VIII all evidenced good transfer efficiency, comparable to that obtained with commercially available IDF 8R2287, in that over 90 percent of the solid ink was transferred from the donor sheet. All images were well fused to the paper and could not be removed by an eraser. The prints from Examples I and III, however, had a tendency to smear when rubbed with an eraser or with one's finger. This was a consequence of the wax or oil-wax blend being too soft.

The overall image quality obtained from the IDFs described in this invention was evaluated by qualitatively comparing the prints with prints obtained using commercially available IDFs. In the key areas of density, sharpness and edge acuity, all print samples, with the exception of Example V, were comparable to those obtained using the commercial IDF 8R2287.

EXAMPLE IX

One gram of Mogul L Carbon Black was added to 70 milliliters of isopropanol and stirred for 1 hour. Nine grams of paraffin wax was added to 20 milliliters of warm (80 degrees Centigrade) Isopar G. When the wax had completely dissolved, the warm solution was added to the stirring carbon black suspension. The mixing and cooling effect of the isopropanol yielded a wax emulsion at room temperature. The emulsion was poured into a 8 oz. polyethylene jar half filled with ¼ inch stainless steel balls, and ball milled for 20 hours. The emulsion was coated on a 12 micron condenser paper by drawing a film of the emulsion over the substrate using a #30 wire-wound rod. The coating was heated slightly to remove residual solvent. The flat black film had an optical density of 1.46. The composition of the final thermal ink donar film was 10 percent carbon black and 90 percent paraffin wax.

EXAMPLE X

Two grams of DDC 2319 Lithol Red pigment was added to 70 milliliters of isopropanol in an 8 oz. polyethylene jar half filled with ¼ inch stainless steel balls, and ball milled for 3 hours. Eight grams of Hoechst Wax E was dissolved in 20 milliliters of warm Isopar G (80 degrees Centigrade). The pigment dispersion was drained into a 250 milliliters beaker and the hot wax solution was added to it with stirring. The emulsion was poured back into the 8 oz. jar and ball milled for 24 hours. The emulsion was coated on 12 micron condenser paper using a #30 wire-wound rod. The coating was warmed slightly to remove the solvents, leaving a bright red film consisting of 20 percent red pigment and 80 percent ester wax.

EXAMPLE XI

One gram of Mogul L carbon black and 0.9 gram of hydroxypropylcellulose, commerially available (average molecular weight=100,000) was added to 70 milliliters of isopropanol. The suspension was stirred for 1 hour. Eight and one tenth grams of Hoechst Wax E was added to 20 milliliters of warm (80 degrees Centigrade) Isopar G. When all the wax had dissolved, the hot solution was added to the stirring carbon black suspension. The resulting emulsion was poured into an 8 oz polyethylene jar, half filled with ¼ inch stainless steel balls. The emulsion was ball milled for 21 hours then coated on condensor paper using a #30 wire-wound rod. The film was heated to remove the residual solvents. The dry film had an optical density of 1.79. The composition of the dry film was 10 percent carbon black, 9 percent hydropropyl cellulose, and 81 percent of ester wax.

EXAMPLE XII

Two grams of BASF Sudan Blue II dye was dissolved in 70 milliliters of isopropanol. Thereafter, 8 grams of Hoechst Wax E was dissolved in 20 milliliters of warm (80 degrees Centigrade) Isopar G. The warm wax solution was added to the stirring dye solution producing a blue wax emulsion. The mixture was poured into an 8 oz. polyethylene jar half filled with ¼ inch stainless steel balls. The emulsion was ball milled for 24 hours, then coated on 7 micron Mylar with a #30 wire-wound rod. The film was heated slightly to remove any residual solvents yielding a bright blue coating. The final composition was 20 percent alcohol soluble dye and 80 percent ester wax.

EXAMPLE XIII

Nine tenths of a gram Mogul L Carbon Black and 0.1 gram of FL-1411 Sherwin Williams alkali flush, a blue pigment, were added to 70 milliliters of isopropanol and stirred for 1 hour. Seven and two tenths grams of Hoechst Wax E, 0.9 gram mineral oil (100 cps) and 0.9 gram Elvax 420 resin was added to 20 milliliters of warm Isopar G (80 degrees Centigrade) and stirred.

When the wax and resin had dissolved, the warm solution was added to the stirring carbon black suspension. The emulsion which was produced was poured into an 8 oz. polyethylene jar half filled with ¼ inch stainless steel balls, and ball milled for 20 hours. The emulsion was coated on 12 micron condenser paper using a #30 wire-wound rod. The film was heated slightly to remove residual solvents yielding a flat black coating with an optical density of 1.51. The final composition of the dry ink donor film was 9 percent carbon black, 1 percent blue pigment, 9 percent mineral oil, 9 percent ethylene-vinyl acetate copolymer, and 72 percent ester wax.

Other modifications of the present invention may occur to those skilled in the art based upon a reading of the present disclosure, and these modifications are intended to be included within the scope of the present invention.

What is claimed is:

1. A process for the preparation of thermal ink donor films which comprises (1) adding to a nonpolar warm hydrocarbon solution wax components, polymer components, or a mixture of wax and polymer components; (2) thereafter adding to the resulting solution first additive components that are soluble therein; (3) forming an emulsion by adding the formed solution to an excess amount of a polar liquid which contains pigment particles; (4) subsequently grinding the resulting emulsion; (5) coating the emulsion product obtained on a supporting substrate; and (6) thereafter heating to enable evaporation of the hydrocarbon component.

2. A process in accordance with claim 1 wherein the wax components are selected from the group consisting of natural, mineral, synthetic, and petroleum waxes.

3. A process in accordance with claim 1 wherein the wax or polymer components are selected from the group consisting of paraffin wax, carnauba wax, beeswax, ethylene-vinyl acetate copolymers and terpene-based resins.

4. A process in accordance with claim 1 wherein the wax or polymer component is present in an amount of from about 20 percent by weight to about 90 percent by weight of the final dry coated film.

5. A process in accordance with claim 1 wherein the hydrocarbon solvent is selected from the group consisting of an aliphatic component with from 5 to about 12 carbon atoms, and an aromatic component with from 6 to about 12 carbon atoms.

6. A process in accordance with claim 1 wherein the hydrocarbon component further contains therein an oil component.

7. A process in accordance with claim 1 wherein the polar liquid is an aliphatic alcohol.

8. A process in accordance with claim 7 wherein the alcohol is methanol, ethanol, propanol or isopropanol.

9. A process in accordance with claim 1 wherein the emulsion grinding is affected for a period of from about 0.5 hour to about 75 hours.

10. A process in accordance with claim 1 wherein subsequent to the grinding process the resulting product which is comprised of a hydrocarbon or nonpolar phase containing dissolved wax components, polymer components, or a mixture of wax and polymer components dispersed in a polar phase containing dispersed pigment or dissolved dye is coated on condenser paper or thin Mylar.

11. A process in accordance with claim 1 wherein the polar liquid is a solvent system comprising alcohol, water, dimethylsulfoxide, dimethylformamide, or mixtures thereof.

12. A process in accordance with claim 1 wherein the evaporation heating is accomplished at a temperature of from about 25 degrees Centigrade to about 150 degrees Centigrade.

13. A process in accordance with claim 1 wherein there are dissolved in the polar phase, soluble polymers selected from the group consisting of hydroxypropyl cellulose, ethyl cellulose, polyethylene glycol and poly(vinyl alcohol).

14. A process in accordance with claim 1 wherein the polar liquid contains dissolved dyes.

15. A process in accordance with claim 1 in which the pigment is carbon black; organic pigments selected from the group consisting of phthalocyanine, nigrosine, azo, triphenylmethane, acridine, alkali blue, and quinones; inorganic components of the iron oxide family; and magnetic components.

16. A process in accordance with claim 1 wherein the polar liquid contains a second additive colorant component comprised of dyes soluble in the polar liquid.

17. A process in accordance with claim 16 wherein the second additive colorant component is selected from the group consisting of crystal violet, methylene blue, sulfur black, Sudan Blue, and direct fast yellow.

* * * * *